US007731043B2

(12) United States Patent
Wang Wu

(10) Patent No.: US 7,731,043 B2
(45) Date of Patent: Jun. 8, 2010

(54) BOTTLE STOPPER FOR SEALING BOTTLE MOUTH TIGHTLY

(76) Inventor: Ching Yueh Wang Wu, P.O. Box 90, Tainan City 70499 (TW)

( * ) Notice: Subject to any disclaimer, the term of this patent is extended or adjusted under 35 U.S.C. 154(b) by 588 days.

(21) Appl. No.: 11/707,982

(22) Filed: Feb. 20, 2007

(65) Prior Publication Data

US 2008/0197104 A1 Aug. 21, 2008

(51) Int. Cl.
*B65D 39/00* (2006.01)
*B65D 39/12* (2006.01)
*B65D 53/00* (2006.01)

(52) U.S. Cl. ..... 215/355; 215/358; 215/359; 215/361; 220/238

(58) Field of Classification Search ..... 215/355, 215/354, 358, 359, 361, 272, 296, 396, 364, 215/279; 220/233–238; 138/93
See application file for complete search history.

(56) References Cited

U.S. PATENT DOCUMENTS 1,383,894 A * 7/1921 Wintherlich ..... 215/359
7,070,046 B2 * 7/2006 Cho ..... 206/221

* cited by examiner

*Primary Examiner*—Robin A. Hylton

(57) ABSTRACT

A bottle stopper includes a cover body, a shaft rod and a rotatable member. The shaft rod is fixed inside the cover body and the rotatable member is secured on the cover body by means of an insert pin, which leans on two opposite oblique faces of the projecting base of the cover body. When the rotatable member is turned clockwise, the insert pin will be actuated to slide upward along the oblique faces of the projecting base and drive the shaft rod to move upward and squeeze a soft clogging member to expand outward and clog the bottle mouth of a bottle. The bottle stopper of this invention can be closely clogged in the bottle mouth, and its shaft rod and soft clogging member are hidden in the cover body, meeting sanitation, convenient in use and able to be placed horizontally for facilitating storing.

2 Claims, 6 Drawing Sheets

BOTTLE STOPPER FOR SEALING BOTTLE MOUTH TIGHTLY

BACKGROUND OF THE INVENTION

1. Field of the Invention

This invention relates to a bottle stopper, particularly to one composed of a cover body, a shaft rod and a rotatable member. The shaft rod is inserted and fixed in the interior of the cover body and the rotatable member is secured on the cover body by means of an insert pin, which leans on and across two oblique faces of the projecting base of the cover body. When the rotatable member is rotated, the insert pin will be actuated to slide upward along the oblique faces of the projecting base of the cover body and drive the shaft rod to move upward and have its bottom stopping member squeezing a soft clogging member to expand outward and closely clogging the bottle mouth. The bottle stopper of this invention can closely clog up the bottle mouth, and its shaft rod and soft clogging body are hidden in the cover body not exposed to the outside, meeting sanitation, convenient in use and able to be placed horizontally for facilitating storing.

2. Description of the Prior Art

Generally, after a bottle of wine is uncorked, the contents in the bottle, such as grape wine, champagne or the like, cannot entirely be drunk up at one time; therefore, it is necessary to cover up the bottle mouth with a bottle stopper so as to keep its contents fresh. A conventional bottle stopper 1 to be clogged in the bottle mouth 19, as shown in FIGS. 1 and 2, includes a shaft rod 10 orderly fitted thereon with a first elastic body 11, a positioning block 12 and a second elastic body 13. The shaft rod 10 has its lower end provided with an expanded member 100 for holding the elastic body 11, 13 and the positioning block 12 and its upper end inserted through a sealing cover 14 and a packing-up plate 15 pivotally connected with a pull lever 16 by means of a pivot 160. Thus, when the pull lever 16 is pulled and pressed downward, the resisting-pressing portion 161 at the lower end of the pull lever 16 will resist against the packing-up plate 15 on the sealing cover 14 and drive the shaft rod 10 to move upward, and simultaneously the expanded member 100 and the positioning block 12 at the lower end of the shaft rod 10 will squeeze the elastic body 11 to let it deformed and expanded outward to clog the bottle mouth 19.

By so designing, however, the conventional bottle stopper has the following defects.

1. When the bottle stopper 1 covered on bottle mouth 19 is to be clogged in the bottle mouth 19, a user has to apply a great force to pull and press the pull lever 16 sideward and downward, thus likely to make the bottle may fall flat and let the interior contents flow out due to unstable center of gravity.

2. The sealing cover 14 is only covered on the upper edge of the bottle mouth 19 so it is unable to be tightly fitted with the bottle mouth 19 and hardly to be held stably for applying force.

3. The shaft rod 10, the two elastic bodies 11, 13 and the positioning block 12 of the conventional bottle stopper 1 are exposed to the outside of the sealing cover 14 so they are likely to be soiled with dirt when they are not used.

4. The conventional bottle stopper 1 cannot be placed horizontally, inconvenient to be stored.

SUMMARY OF THE INVENTION

The objective of this invention is to offer a bottle stopper able to really clog a bottle mouth and whose rod body and clogging body are not exposed to the outside, meeting sanitation, convenient in use and able to be placed horizontally.

The bottle stopper in the present invention includes a cover body, a shaft rod and a rotatable member. The cover body has its lower portion formed with a recessed chamber provided therein with a lengthwise pillar bored with a shaft hole in the interior. Further, the cover body has its upper inner circumference bored with an annular recess and its upper central portion provided with a projecting base having its circumferential wall reversely cut with two oblique faces opposite to each other. The shaft rod inserted in the shaft hole of the cover body has its lower end secured with a stopping member having its topside thereon with a soft clogging member and has its upper end transversely and oppositely bored with two insert holes. The rotatable member fitted on the cover body has its lower portion provided with an accommodating chamber and its circumferential wall bored with two insert holes aligned to each other for an insert pin to be inserted therein, and further has its upper side mounted with a handle.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
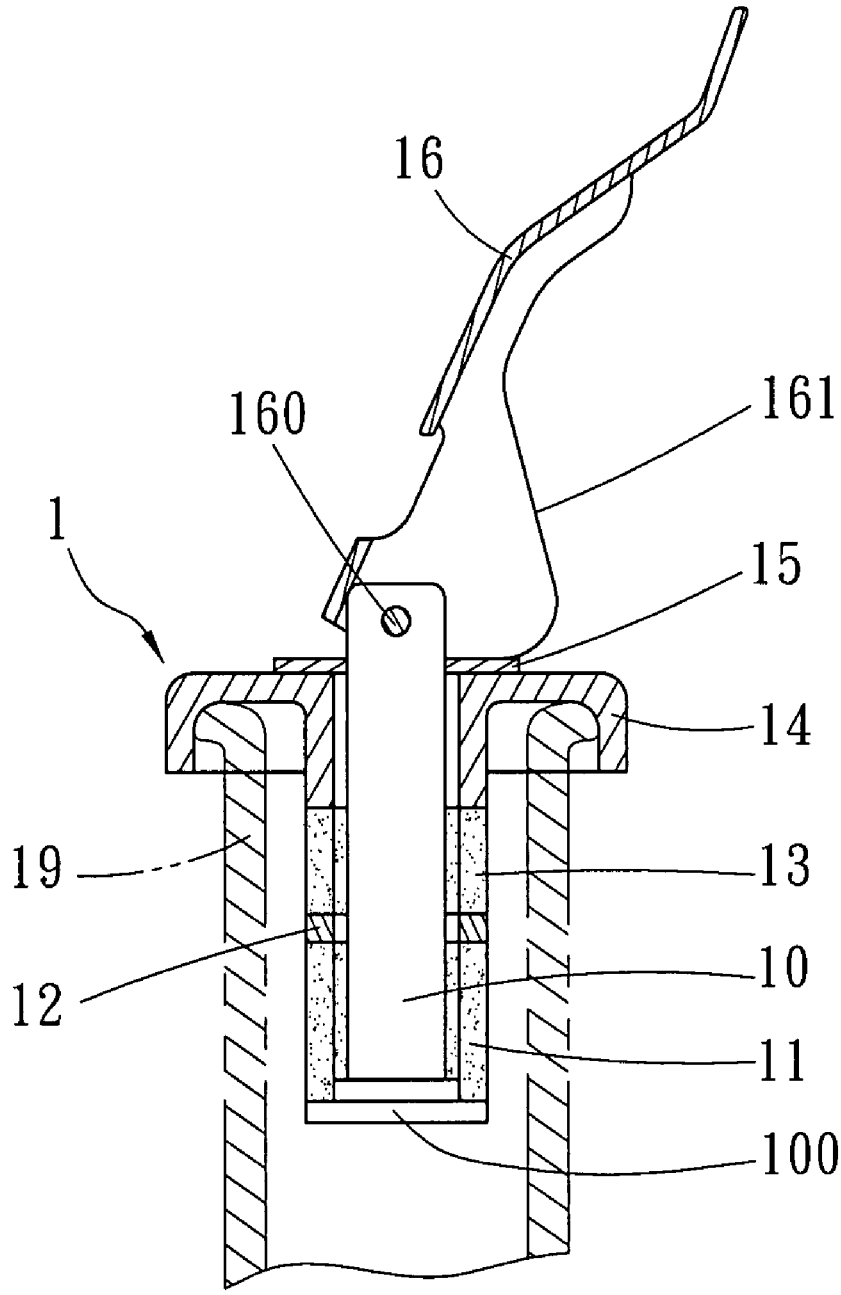
FIG.1 (PRIOR ART)
FIG. 1 is a cross-sectional view of a conventional bottle stopper not yet clogged in a bottle mouth.
Figure 2:
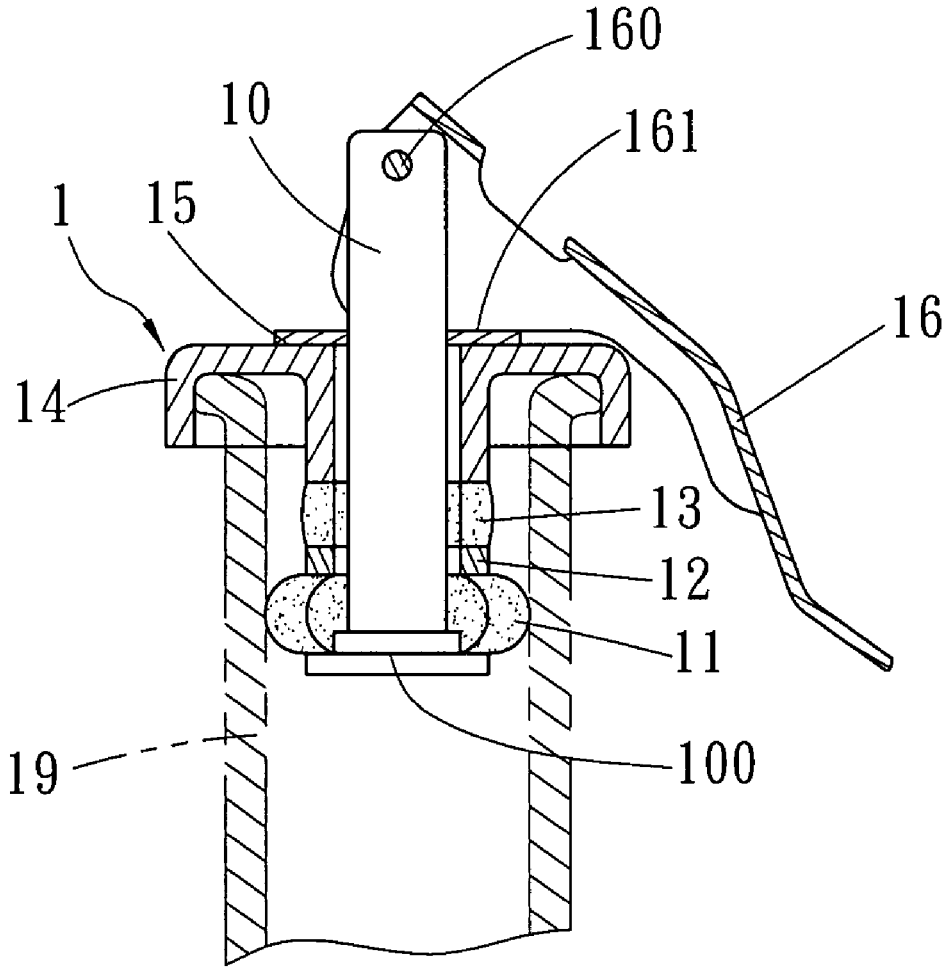
FIG.2 (PRIOR ART)
FIG. 2 is a cross-sectional view of the conventional bottle stopper clogged in the bottle mouth.
Figure 3:
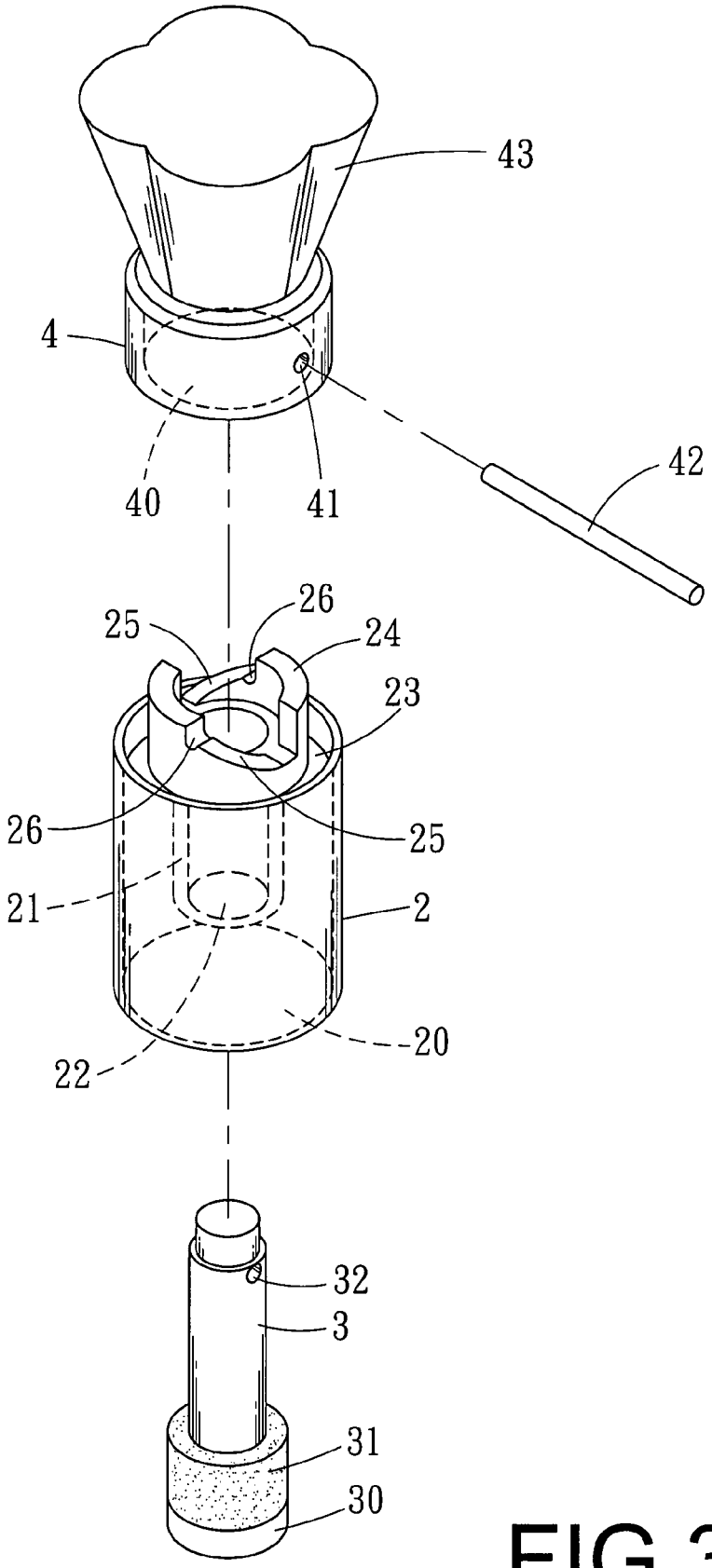
FIG. 3 is an exploded perspective view of a bottle stopper in the present invention.
Figure 4:
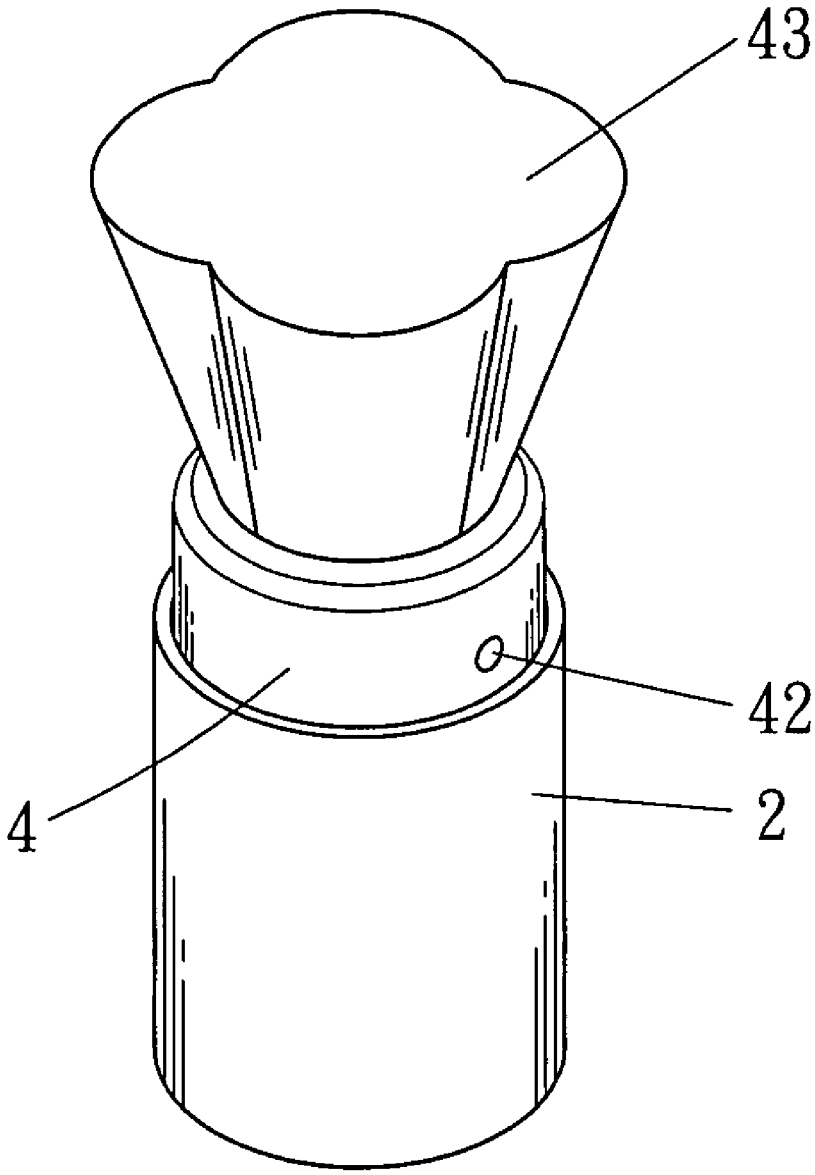
FIG. 4 is a perspective view of the bottle stopper in the present invention.

A preferred embodiment of a bottle stopper in the present invention, as shown in FIGS. 3 and 4, includes a cover body 2, a shaft rod 3 and a rotatable member 4 as main components combined together.

The cover body 2 has its lower portion formed with a recessed chamber 20 provided therein with a lengthwise pillar 21 bored inside with a shaft hole 22 extending through the topside of the cover body 2. The cover body 2 further has its upper inner circumference bored with an annular recessed groove 23 and its upper center disposed with a projecting base 24 having its circumferential wall reversely cut with two oblique faces 25 opposite to each other. The two oblique cross sections 25 respectively have the apex provided with an engage groove 26.

The shaft rod 3 inserted in the shaft hole 22 of the cover body 2 has its lower end secured with a stopping member 30 having its topside mounted thereon with a soft clogging member 31 and further has its wall near the topside bored with two insert holes 32 aligned to each other.

The rotatable member 4 fitted on the topside of the cover body 2 has its lower portion provided with an accommodating chamber 40 and its circumferential wall bored with two insert holes 41 aligned to each other for an insert pin 42 to be inserted therein. The rotatable member 4 further has its topside fixed with a handle 43.

Figure 5:
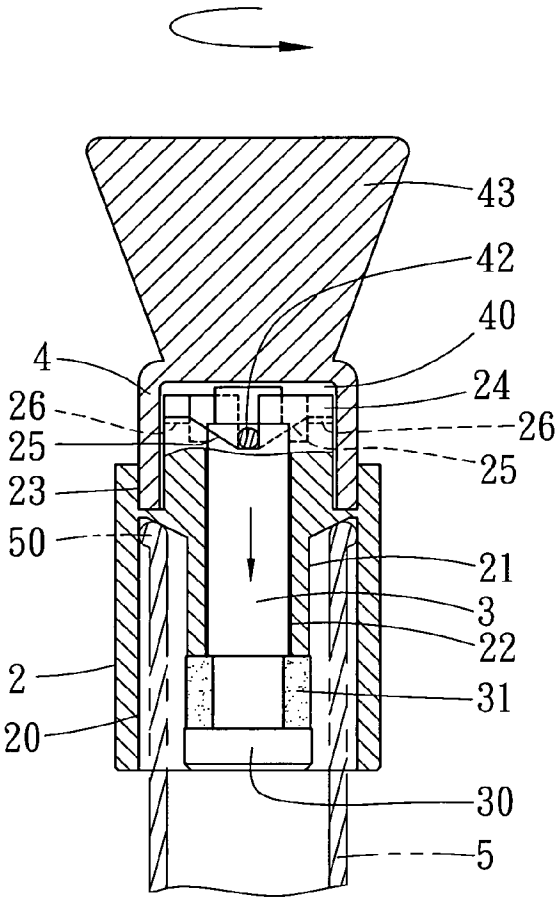
FIG. 5 is a cross-sectional view of the bottle stopper to be clogged in a bottle mouth in the present invention.

In assembling, as shown in FIGS. 3, 4 and 5, firstly, the shaft rod 3 is inserted in the shaft hole 22 of the cover body 2, letting the upper edge of the soft clogging member 31 lean on the lower edge of the lengthwise pillar 21 of the cover body 2. At this time, the soft clogging member 31 is positioned between the stopping member 30 and the lower edge of the lengthwise pillar 21, and the upper end of the shaft rod 3 is located in the interior of the projecting base 24 of the cover body 2. Next, the rotatable member 4 is mounted on the cover body 2 and has its lower end fitted in the annular recessed groove 23 of the cover body 2, letting the projecting base 24 of the cover body 2 received in the accommodating chamber 40 of the rotatable member 4. Then, turn the rotatable member 4 to have its opposite insert holes 41 respectively aligned to the two insert holes 32 at the upper end of the shaft rod 3 inside the projecting base 24 of the cover body 2. Lastly, the insert pin 42 is inserted in the insert holes 41, 31 to firmly position the rotatable member 4 on the cover body 2 and at this time, the insert pin 42 is positioned on and across the two oblique faces 25 of the projecting base 24 of the cover body 2, thus finishing assembly of the bottle stopper.

Figure 6:
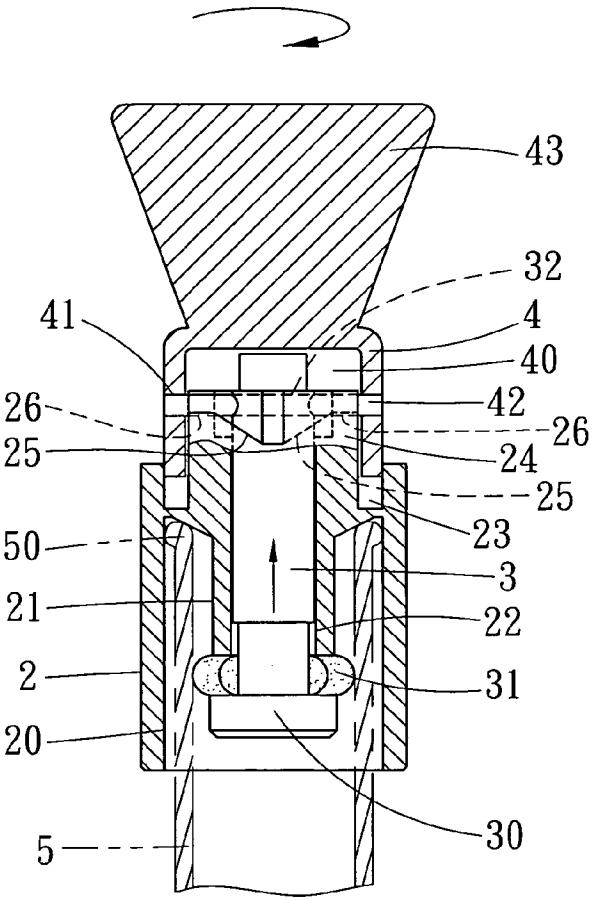
FIG. 6 is a cross-sectional view of the bottle stopper clogged in the bottle mouth in the present invention.
Figure 7:
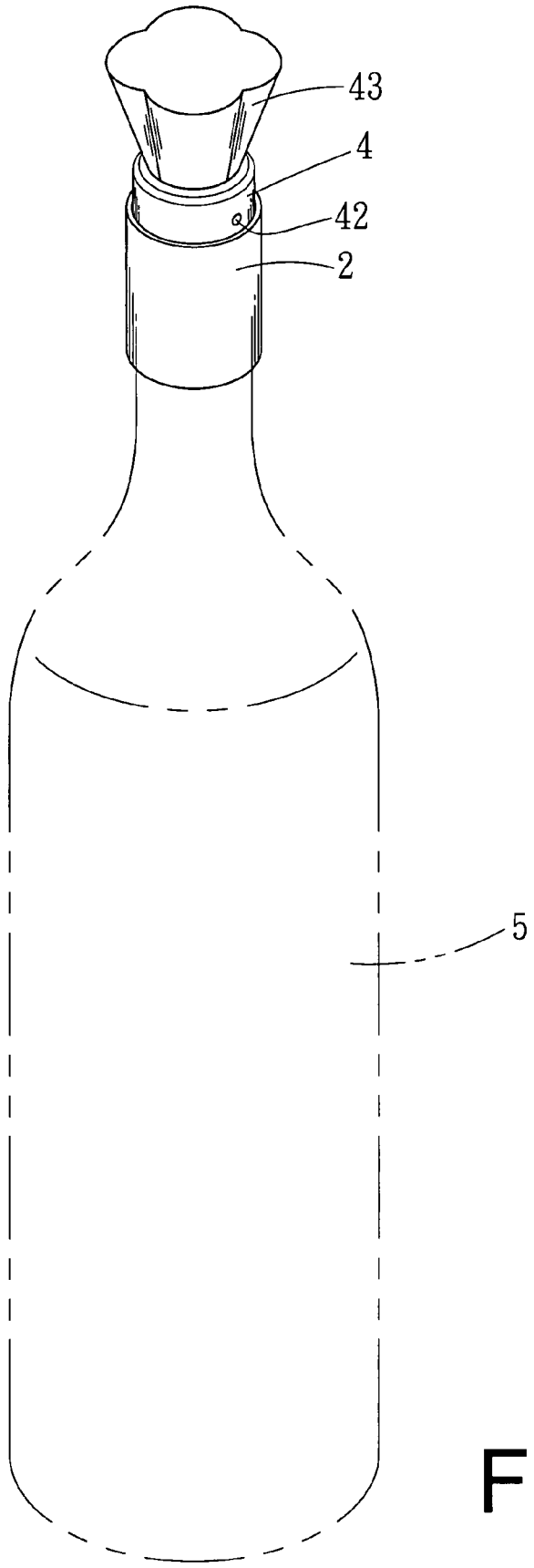
FIG. 7 is a perspective view of the bottle stopper in a using condition in the present invention.

In using, as shown in FIGS. 5, 6 and 7, the cover body 2 is first covered on the bottle mouth 50 of a bottle 5, letting the outer wall of the cover body 2 cover up the outer side of the bottle mouth 50 and the shaft rod 3 inserted in the bottle mouth 50, and then hold the handle 43 and turn the rotatable member 4 clockwise. Simultaneously, the insert pin 42 will be rotated together with the rotatable member 4 and slide upward along the oblique faces 25 of the projecting base 24 of the cover body 2 and, when moved to the apex of the oblique faces 25, the insert pin 42 will be engaged and positioned in the engage groove 26. When the insert pin 42 is moved upward along the oblique faces 25, the shaft rod 3 will be actuated to move upward and have its bottom stopping member 30 squeezing the soft clogging member 31 and forcing it to expand outward and clog the bottle mouth 50, thus effectively sealing up the bottle mouth 50 for keeping fresh the contents in the bottle 5. To remove the bottle stopper from the bottle mouth 50, only hold the handle 43 and turn the rotatable member 4 counterclockwise to actuate the insert pin 42 to slide downward along the oblique faces 25 of the projecting base 24. Synchronously, the shaft rod 3 will be actuated to move downward to let its soft clogging member 31 elastically recover its original shape and no longer clog the bottle mouth 50, and thus the bottle stopper can easily be removed from the bottle mouth 50, convenient in use.

To sum up, this invention has the following advantages.

1. The cover body 2 of the bottle stopper can be closely covered on the outer side of the bottle mouth 50, able to be fitted tight and convenient to be held.

2. The force applying point for covering the bottle stopper on the bottle mouth 50 is right in the center; therefore, when the bottle stopper is operated to be clogged in the bottle mouth 50, the bottle can easily be held stably not to fall flat.

3. The shaft rod 3 and the soft clogging member 31 of the bottle stopper are hidden in the recessed chamber 20 of the cover body 2 so they can always be kept clean, meeting sanitation.

4. The bottle stopper of this invention can be horizontally placed on the top of a table, convenient to be stored.

While the preferred embodiment of the invention has been described above, it will be recognized and understood that various modifications may be made therein and the appended claims are intended to cover all such modifications that may fall within the spirit and scope of the invention.

What is claimed is:

1. A bottle stopper comprising:

a cover body having its lower portion formed with a recessed chamber which is opened at a lower side of said cover body, said recessed chamber provided therein with a lengthwise pillar extending from an upper side of said recessed chamber, said lengthwise pillar bored with a shaft hole in the interior, said cover body bored with an annular recessed groove in the topside, said cover body further having its upper center which is opened at a top end of said cover body; and being disposed with a projecting base which is projected from a lower side of said annular recessed groove, said projecting base having its wall reversely cut with two oblique faces opposite to each other;

a shaft rod inserted in said shaft hole of said cover body, a lower end of said shaft rod being secured with a stopping member, a soft clogging member being positioned on an upper side of said stopping member and enclosing a lower side of said shaft rod; said shaft rod having its upper end bored with two insert holes aligned to each other; and a rotatable member mounted on said cover body, said rotatable member having its lower portion formed with an accommodating chamber, said rotatable member having its circumferential wall bored with two insert holes aligned to each other for an insert pin to be inserted therein, said rotatable member having its topside fixed with a handle; and wherein in an assembled state, said shaft rod is inserted in said shaft hole of said cover body so that an upper edge of said soft clogging member leans on a lower edge of said lengthwise pillar of said cover body, and meanwhile said soft clogging member is positioned between said stopping member and a lower edge of said lengthwise pillar, and an upper end of said shaft rod is located in an interior of said projecting base of said cover body; said rotatable member is mounted on said cover body and has a lower end thereof fitted in said annular recessed groove of said cover body, causing said projecting base of said cover body received in said accommodating chamber of said rotatable member; said rotatable member to have its insert holes respectively aligned to said two insert holes at said upper end of said shaft rod inside said projecting base of said cover body; and said insert pin is inserted in said insert holes to firmly position said rotatable member on said cover body and at this time, said insert pin is positioned on and across said two oblique faces of said projecting base of said cover body, thus finishing assembly of said bottle stopper.

2. The bottle stopper as claimed in claim 1, wherein said two oblique faces of said projecting base of said cover body respectively have an apex provided with an engage groove for positioning said insert pin.

* * * * *